US007712393B2

(12) United States Patent
Bertani

(10) Patent No.: US 7,712,393 B2
(45) Date of Patent: May 11, 2010

(54) SAFETY FOLD-AWAY HANDLE

(75) Inventor: Alberto Bertani, Milan (IT)

(73) Assignee: Elesa S.p.A., Milan (IT)

( * ) Notice: Subject to any disclaimer, the term of this patent is extended or adjusted under 35 U.S.C. 154(b) by 806 days.

(21) Appl. No.: 11/557,172

(22) Filed: Nov. 7, 2006

(65) Prior Publication Data

US 2007/0137404 A1 Jun. 21, 2007

(30) Foreign Application Priority Data

Nov. 9, 2005 (IT) ..... MI2005U0393 U

(51) Int. Cl.
*G05G 1/00* (2006.01)
*B25G 1/04* (2006.01)

(52) U.S. Cl. ..... 74/547; 74/543; 74/545; 16/429; 16/438; 16/445

(58) Field of Classification Search ..... 16/429, 16/436, 438, 445; 242/283, 284, 405.2, 405.3, 242/588.2, 591, 592; 81/177.6, 177.7, 177.8, 81/177.9; 74/543–547, 551.3, 523, 524; *G05G 1/04*
See application file for complete search history.

(56) References Cited

U.S. PATENT DOCUMENTS 3,948,117 A * 4/1976 Kimura ..... 74/547
4,552,034 A 11/1985 Bertani et al.
5,244,166 A * 9/1993 Oi ..... 242/284
5,368,249 A * 11/1994 Takeuchi ..... 242/284
5,443,570 A * 8/1995 Hirano ..... 242/284
7,055,220 B2 * 6/2006 Bertani ..... 16/436

FOREIGN PATENT DOCUMENTS

IT 1149640 12/1986
JP 2003-216257 * 7/2003

* cited by examiner

*Primary Examiner*—Vinh T. Luong
(74) *Attorney, Agent, or Firm*—Pearne & Gordon LLP

(57) ABSTRACT

A safety grip for a handwheel which is movable between an operating position and a home position is comprised of an elongated and ergonomic body (1) and of a support (2), which is anchored to the body of a maneuvering member, such as a handwheel. The body (1) is comprised of an outer case (1*a*), a rod-like inner core (3) with a head (4), a bushing (6) slidably mounted on the core (3), a sleeve (7) in sliding engagement on the bushing (6), an axial thrust spring (9) arranged between two opposite shoulders (6*a*) and (7*a*) of the bushing (6) and of the sleeve (7), and a second thrust spring (10) arranged between the head (4) and the top of the bushing (6). The body (1) is connected to the support (2) at a pivot point (5). An end of the sleeve (7) engages a contact surface of the support (2) through a collar (8). The collar (8) has an inner conical mouth surface that engages a shaped rib (11) on the top of said support (2), where the shaped rib (11) has a frusto-conical outer surface.

10 Claims, 2 Drawing Sheets

SAFETY FOLD-AWAY HANDLE

RELATED APPLICATIONS

This application claims the benefit of Italian application, MI2005U 000393, filed on Nov. 9, 2005, the entire disclosure of which is hereby incorporated herein by reference.

FIELD OF THE INVENTION

The present invention relates generally to a safety fold-away handle or a collapsible, automatic-release grip for control and maneuvering devices.

BACKGROUND OF THE INVENTION

Grips are known in the art for rotating, or moving, control and maneuvering devices, such as handwheels, which allow complete adjustment or moving operations in the most disparate application fields.

Automatic-release grips are also known. These types of grips typically have snap devices which cause them to disappear into the handwheels.

In prior art devices, the means to guarantee the automatic release of the grip from the handwheel consisted of torsion springs. However, torsion springs had the significant disadvantage of being too fragile, and consequently of easily breaking within a very short time.

Alternative devices have thus been developed, comprising compression springs instead of the usual torsion springs. For example, the Applicant's patent no. IT 1,149,640 concerns an automatic-snap, collapsible safety grip for maneuvering members which may be coupled, through axial shifting, in its maneuvering position, with the body of the suitably shaped maneuvering member. In particular, means for stake coupling with the handle are provided, which were coupled against the action of return springs, as well as unlocking means consisting of a counter-stake spring-loaded against the coupling of the coupling stake. This type of construction certainly solves the problems of quick wear of the torsion springs, but over time is susceptible to accidental jams, which prevent a full and effective collapsing action.

Although the above-mentioned counter-stake is provided to guarantee the lifting of the grip from the support and the consequent release thereof, once the operations on the handwheel have been completed, the grip often remains jammed in-side the support and a manual action is necessary to achieve the collapse thereof.

Accordingly, there is a need for a grip which is which is capable of overcoming the stated disadvantages. The present invention is capable of performing an easy, automatic, and safe collapse of the grip once the operator has completed the adjustment operations on the handwheel and simply releases the grip.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
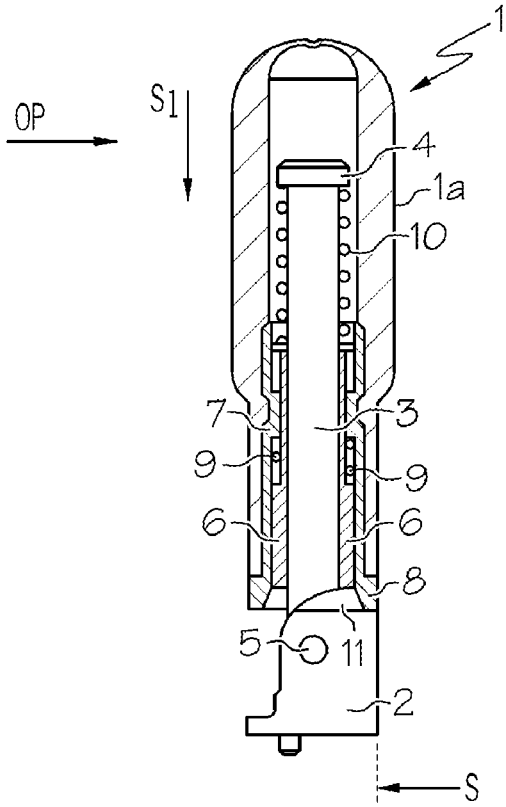
FIG. 1 is an axial section of the grip in an operating position.

Certain terminology is used herein for convenience only and is not to be taken as a limitation on the present invention. Further, in the drawings, the same reference numerals are employed for designating the same elements.

Figure 4:
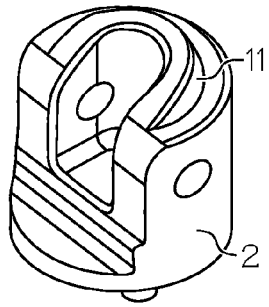
FIG. 4 is a perspective view of the support according to the invention.

The grip according to the invention consists of an elongated and ergonomic body 1 and of a support 2. The support 2 can be anchored to the body of a maneuvering member (not shown), such as a handwheel. The support 2 has at its top a shaped engagement rib 11. As seen in FIG. 4, the outer surface of the engagement rib can be frusto-conical, though it can also include various other geometries.

The body 1 is comprised of an outer case 1*a*, an inner rod-like core 3, and a head 4 on the core 3. The body 1 is connected to the support 2 at a center of rotation of a pivot point 5. Pivoting of the body 1 can be accomplished by inserting a transversal pin or the like into the pivot point 5. A bushing 6 can be slidably mounted on the core 3 of grip. A sleeve 7 can be provided that can be attached to, or be integral with, the outer case 1*a* and ends in a lower, conical-mouth collar 8. The sleeve 7 is slidingly engaged with the bushing 6.

The bushing 6 and the sleeve 7 have opposite shoulders 6A, 7A. A first axial thrust spring 9 is arranged between the two opposite shoulders 6A, 7A. A second thrust spring 10 surrounds an upper portion of the core 3. The second thrust spring 10 is arranged between the head 4 of the core 3, and a top portion 12 of the bushing 6.

The engagement rib 11 can have a conical surface forming an angle to the normal, such as an angle of 20°, though various other angles are also contemplated. With an angled surface, the engagement rib 11 is capable of engaging with the inner surface of the conical-mouth collar 8, which has an angle with the normal that complements the engagement rib 11, such as the same 20° angle. This 20° angle is purely an example, and it is of course possible to adopt a different angle. Other angles can be used, provided the conical shape of the engagement rib 11 and the conical-mouth collar 8 still provide a quick and safe release of the grip from the engagement rib 11 at the end of the handwheel moving operations.

Figure 2:
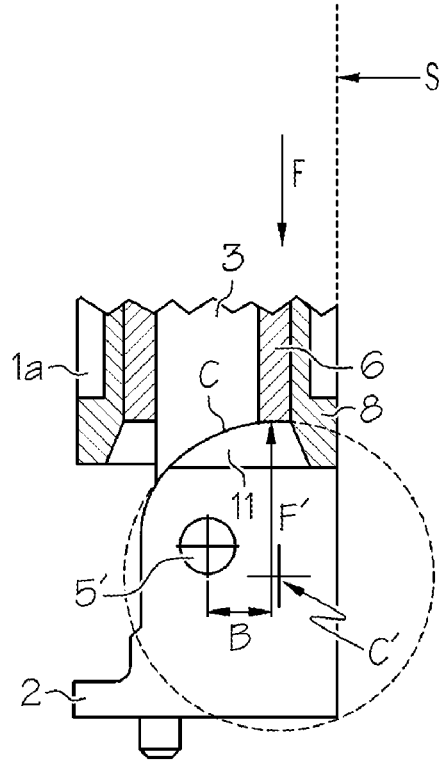
FIG. 2 is the detail of the portion encircled in FIG. 1.
Figure 3:
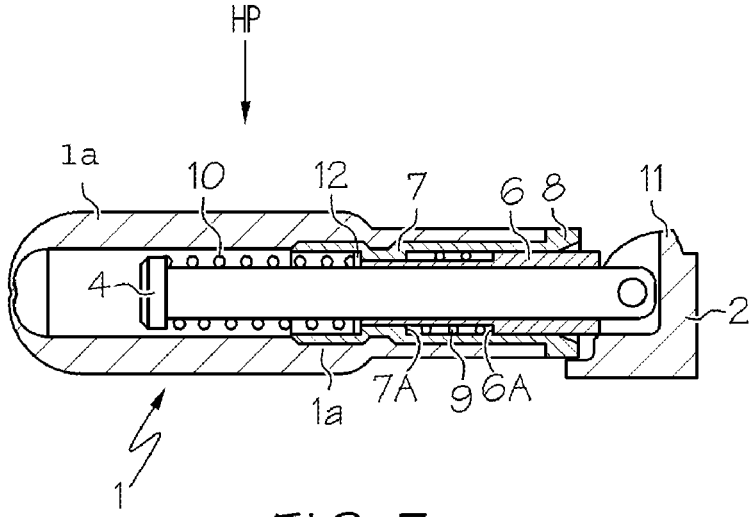
FIG. 3 is an enlarged axial section of the same grip in a home position.

The support 2 and the engagement rib 11 are manufactured so that the contact surface of the engagement rib 11 with a lower end of the bushing 6 forms a generally continuous arc C. The generally continuous arc C can be seen in FIG. 2 and in FIG. 4. It is to be appreciated that the generally continuous arc can have various geometries. As shown, the geometry can be circular, though the geometry can also be oval, elliptical, exponential, substantially linear, etc. The generally continuous arc C can have its center C' laterally offset by a distance with respect to the center of rotation of pivot point 5, as seen in FIGS. 1, 2, and 3. Thereby, as seen in FIG. 2, a thrust force F against the arc surface of the engagement rib 11 is imparted by the bushing 6, under the pressure of second thrust spring 10, and generates an opposite reaction force F' acting from the support 2 onto the bushing 6. Such opposite reaction force F' has a torque arm B with respect to the center of rotation of pivot point 5, creating a torque which causes the safe rotation of the grip towards the home position HP shown in FIG. 3.

The torque arm B can represent the distance from the center of rotation of pivot point 5 to the application of the reaction force F'. The profile of the generally continuous-arc surface C with respect to the center of rotation of pivot point 5 of the grip is such that the reaction force F' is applied at a distance B from the center of rotation of the pivot point 5, where the distance B generally avoids a null value of the opposite reaction force F' during the entire rotation of the grip from its operating position OP to its home position HP.

This arrangement, taken together with the second thrust spring 10 being compressed, causes a torque to be imparted that is intended to ensure that the grip is biased towards collapsing into its home position HP with respect to the handwheel (not shown).

Figure 5A:
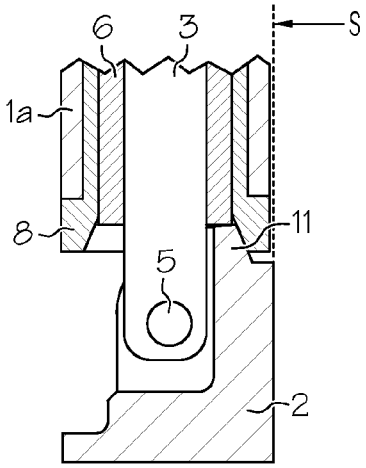
FIGS. 5A and 5B are two views similar to FIG. 2 in two subsequent stages of the movement between the operating position and the home position.
Figure 5B:
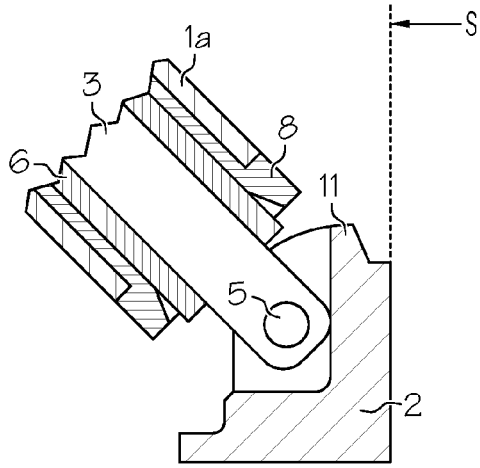

During operation, the operator lifts the grip, from the home position HP of FIG. 3, towards a generally vertical line S (FIGS. 2, 5*a*, 5*b*), until it reaches the generally vertical position of FIG. 1 (i.e. the operating position OP). It is to be appreciated that the generally vertical position can be geometrically vertical, but can also permit some degree of angular offset with respect to a geometrically vertical position. At the operating position OP of FIG. 1, the collar 8 can be pushed into engagement with the rib 11 of the support 2. The collar 8 can be pushed into engagement due to the action on outer case 1*a* of a force in the direction of S1, following which the operator can use hand grip to cause the handwheel to rotate safely according to his requirements.

The force imparted by first axial spring 9 acts against the operator's thrust force on the hand grip, in the direction of S1. This force imparted by first axial spring 9 can permit the operator to use a minimal amount of force to engage the grip with the support 2.

Once adjustment of the handwheel position has been completed, the operator can release the grip. The reaction force of first axial spring 9 can then cause the disengagement of the grip from the support 2. Simultaneously, under the force of the second thrust spring 10, which can be stronger than the first axial spring 9, the rotation of the grip can begin towards a direction away from the generally vertical line S. The rotation can be eased by the suitable 20° angle (or other angle) of the exit cone of the mouth of collar 8. The angled surface of the engagement rib 11 can allow an automatic and immediate sliding out of the grip from the engagement with the support 2 and the engagement rib 11, resulting in the generally 90° collapsing of the grip. However, it is to be appreciated that the angle from the operating position OP to the home position HP may vary from 90° as required by the application. Thereby, the grip returns in its home position HP (FIG. 3) inside the handwheel.

The desired object of a grip performing a generally 90° rotation has hence been achieved. The grip has thrust springs, rather than torsion springs, to ease the movement, which can significantly lower the risk of breakage of the spring means and can extend the grip life.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A safety grip device, which is movable between an operating position and a home position, comprising: an elongated and ergonomic body (1) and a support (2), wherein the body (1) comprises an outer case (1*a*), a rod inner core (3) with a head (4), a bushing (6) slidably mounted on the core (3), a sleeve (7) in sliding engagement on the bushing (6), an axial thrust spring (9) arranged between two opposite shoulders (6*a*) and (7*a*) of the bushing (6) and of the sleeve (7), a second thrust spring (10) is arranged between the head (4) and the top of said bushing (6), and the body (1) is connected to the support (2) at a pivot point (5); wherein the support (2) is anchored to the body of a maneuvering member; wherein an end of the sleeve (7) engages a contact surface of the support (2) through a collar (8); wherein the collar (8) has an inner conical mouth surface that engages a shaped rib (11) on the top of said support (2), wherein the shaped rib (11) has a frusto-conical outer surface.

2. The safety grip device of claim 1, wherein both of the conical surfaces of said rib (11) and said inner surface of the collar (8) have substantially the same angle with respect to the vertical axis of support (2) and the sleeve (7) when the sleeve (7) is in a generally vertical position.

3. The safety grip device of claim 2, wherein the angle of the conical surfaces is generally a 20° angle.

4. The safety grip device of claim 3, wherein the contact surface of the support (2) and of the rib (11) form a generally continuous arc.

5. The safety grip device of claim 2, wherein the contact surface of the support (2) and of the rib (11) form a generally continuous arc.

6. The safety grip device of claim 5, wherein an end edge of the bushing (6) rests on said generally continuous-arc surfaces, due to a thrust force of the second thrust spring (10), and wherein the generally continuous-arc surfaces cause the thrust force of said second thrust spring (10) to generate an opposite reaction force (F').

7. The safety grip device of claim 1, wherein an end edge of the bushing (6) rests on said generally continuous-arc surfaces, due to a thrust force of the second thrust spring (10), and wherein the generally continuous-arc surfaces cause the thrust force of said second thrust spring (10) to generate an opposite reaction force (F').

8. The safety grip device of claim 7, wherein said opposite reaction force (F') is applied to the hand grip at a distance (B) spaced from the center of rotation (5) of said grip, generating a torque which causes the rotation of said hand grip.

9. The safety grip device of claim 8, wherein the profile of said generally continuous-arc surface with respect to the center (5) of rotation of the grip is such that the opposite reaction force (F') is applied at a distance (B) from the center of rotation (5) where the distance (B) avoids a null value of the opposite reaction force (F') during the rotation of the grip from its operating position to its home position.

10. The safety grip device of claim 9, wherein a compression force imparted by said second thrust spring (10) eases the rotation of the grip (1) towards its home position.

* * * * *